US012292229B2

(12) United States Patent
Passley

(10) Patent No.: US 12,292,229 B2
(45) Date of Patent: May 6, 2025

(54) FOLDABLE REFRIGERATOR

(71) Applicant: Shaun Passley, Chicago, IL (US)

(72) Inventor: Shaun Passley, Chicago, IL (US)

(73) Assignee: Epazz, Inc, Chicago, IL (US)

( * ) Notice: Subject to any disclaimer, the term of this patent is extended or adjusted under 35 U.S.C. 154(b) by 66 days.

(21) Appl. No.: 18/100,715

(22) Filed: Jan. 24, 2023

(65) Prior Publication Data

US 2024/0247863 A1 Jul. 25, 2024

(51) Int. Cl.
*F25D 23/06* (2006.01)
*F25D 11/00* (2006.01)

(52) U.S. Cl.
CPC ..... *F25D 23/063* (2013.01); *F25D 11/00* (2013.01); *F25D 2323/061* (2013.01)

(58) Field of Classification Search
CPC ..... F25D 23/063; F25D 11/003; F25D 17/06; F25D 2400/38; F25D 2400/32; F25D 2400/12; F25D 2323/061; F25D 25/027; F25D 23/00; F25D 11/00; E04B 1/34
See application file for complete search history.

(56) References Cited

U.S. PATENT DOCUMENTS 2,605,617 A * 8/1952 Replogle ..... F25D 23/062 312/258
3,966,286 A * 6/1976 Groseclose ..... A47B 43/00 312/258
5,340,207 A * 8/1994 Chen ..... A47B 43/00 312/262
5,593,046 A * 1/1997 Katsuura ..... H05K 7/1424 312/258
5,664,854 A * 9/1997 Letch ..... A47F 3/004 312/258
6,073,943 A * 6/2000 Serrault ..... B65F 1/122 280/30
7,748,798 B2 * 7/2010 LeTourneau ..... A47B 43/00 312/258
9,301,603 B1 * 4/2016 Koehn ..... A47B 47/00
2005/0174019 A1 * 8/2005 Chi-Sheng ..... A47B 67/04 312/258
2006/0289336 A1 * 12/2006 Ford ..... B65D 81/36 206/478
2007/0210682 A1 * 9/2007 Wise ..... A47B 87/00 312/108
2007/0256440 A1 * 11/2007 Trotter ..... F25D 23/063 62/298

(Continued)

FOREIGN PATENT DOCUMENTS

GB 2418842 A * 4/2006 ..... A45C 13/42
WO WO-2017127035 A1 * 7/2017

*Primary Examiner* — Hiwot E Tefera
(74) *Attorney, Agent, or Firm* — Justin Lampel

(57) ABSTRACT

A foldable refrigerator is provided. The foldable refrigerator moves from a functional First Position A to a collapsed Second Position B. The foldable refrigerator may be folded into the collapsed Second Position B for transportation and/or storage. The foldable refrigerator has an extendable handle and wheels which allow pulling or pushing the refrigerator in a manner similar to luggage. The refrigerator further has extendable and adjustable legs which allow the refrigerator to be raised or lowered to various heights. The refrigerator has a gyroscope which allows the compressor of the refrigerator to remain in an upright position.

13 Claims, 6 Drawing Sheets

(56) References Cited

U.S. PATENT DOCUMENTS

| | | | | |
|---|---|---|---|---|
| 2008/0284302 | A1* | 11/2008 | Olson | F25D 23/062 312/265.5 |
| 2010/0122964 | A1* | 5/2010 | Lin | A47B 43/00 248/220.1 |
| 2010/0259139 | A1* | 10/2010 | Tussy | A45C 13/18 312/213 |
| 2013/0319020 | A1* | 12/2013 | Neeld | F25B 49/02 62/126 |
| 2014/0345316 | A1* | 11/2014 | Godbole | A47B 47/00 312/265.5 |
| 2015/0090859 | A1* | 4/2015 | Deryckere | B62B 3/005 248/676 |
| 2015/0241109 | A1* | 8/2015 | Passley | F25D 11/003 62/426 |
| 2015/0292783 | A1* | 10/2015 | Trotter | F25D 23/06 62/235.1 |
| 2015/0298886 | A1* | 10/2015 | Knight | B65D 81/18 220/592.2 |
| 2016/0003505 | A1* | 1/2016 | Trotter | F25B 27/007 62/235.1 |
| 2017/0039511 | A1* | 2/2017 | Corona | G06Q 10/087 |
| 2019/0170429 | A1* | 6/2019 | Kim | F25D 11/02 |
| 2020/0218482 | A1* | 7/2020 | Park | G06F 3/14 |
| 2022/0395092 | A1* | 12/2022 | Holland | A47B 43/00 |

* cited by examiner

FOLDABLE REFRIGERATOR

BACKGROUND OF THE INVENTION

A foldable refrigerator is provided. The foldable refrigerator moves from a functional First Position A to a collapsed Second Position B. The foldable refrigerator may be folded into the collapsed Second Position B for transportation and/or storage. The foldable refrigerator has an extendable handle and wheels which allow pulling or pushing the refrigerator in a manner similar to luggage. The refrigerator further has extendable and adjustable legs which allow the refrigerator to be raised or lowered to various heights. The refrigerator has a gyroscope which allows the compressor of the refrigerator to remain in an upright position.

Attempts have been made to provide foldable cooling devices. For example, U.S. Pat. No. 5,403,095 to Melk discloses a thermally insulating carrier for preventing temperature change of heated or cooled items placed therein. The carrier includes a flexible bag-like container having a compartment therein and a generally rigid hollow tub-like liner member which is removably disposed in the compartment. The flexible container includes a side wall portion, a base portion, and a displaceable cover. At least the side wall portion and cover are constructed incorporating a flexible insulating material for providing an insulating effect. The side wall portion is joined with the base portion and together with the cover define the compartment. A container aperture is defined by a top edge of the side wall portion. A closing device is attached to the container aperture and a perimeter of the cover for releasably retaining the cover over the container aperture. The hollow liner is integrally formed of a rigid, waterproof, and shatterproof material with side portions joined to a bottom portion. A mouth is formed around the top of the liner and is coincident with the container aperture. The liner improves the thermal characteristics, provides structural support for the flexible container, and prevents leakage of moisture from the flexible container.

Still further, U.S. Pat. No. 5,472,279 to Lin discloses a thermally insulating carrier for preventing temperature change of heated or cooled items placed therein. The carrier includes a flexible bag-like container having a compartment therein and a generally rigid hollow tub-like liner member which is removably disposed in the compartment. The flexible container includes a side wall portion, a base portion, and a displaceable cover. At least the side wall portion and cover are constructed incorporating a flexible insulating material for providing an insulating effect. The side wall portion is joined with the base portion and together with the cover define the compartment. A container aperture is defined by a top edge of the side wall portion. A closing device is attached to the container aperture and a perimeter of the cover for releasably retaining the cover over the container aperture. The hollow liner is integrally formed of a rigid, waterproof, and shatterproof material with side portions joined to a bottom portion. A mouth is formed around the top of the liner and is coincident with the container aperture. The liner improves the thermal characteristics, provides structural support for the flexible container, and prevents leakage of moisture from the flexible container.

However, these cooling devices fail to disclose a foldable refrigerator which is easy to use and efficient. A need, therefore, exists for an improved foldable refrigerator and method of using the same.

SUMMARY OF THE INVENTION

A foldable refrigerator is provided. The foldable refrigerator moves from a functional First Position A to a collapsed Second Position B. The foldable refrigerator may be folded into the collapsed Second Position B for transportation and/or storage. The foldable refrigerator has an extendable handle and wheels which allow pulling or pushing the refrigerator in a manner similar to luggage. The refrigerator has a gyroscope which allows the compressor of the refrigerator to remain in an upright position.

An advantage of the present device is to provide a foldable refrigerator having a portable power source.

And another advantage of the present device is to provide a foldable refrigerator having a sealing means for securely sealing the refrigerator and conserving energy.

Yet another advantage of the present device is to provide a foldable refrigerator having an interior camera.

And another advantage of the present device is to provide a foldable refrigerator having an exterior looking security camera.

In an embodiment, the security camera may provide a three-hundred-and-sixty-degree view of the surrounding area.

Still another advantage of the present device is to provide a foldable refrigerator having a means for monitoring the contents and location of the refrigerator.

An advantage of the present device is to provide a foldable refrigerator which is easy to transport.

Yet another advantage of the present device is to provide a foldable refrigerator which is easy to store.

And advantage of the present device is to provide a foldable refrigerator which is environmentally friendly.

Yet another advantage of the present foldable refrigerator is that the device may have an interior having multiple temperature zones.

Yet another advantage of the foldable refrigerator is that the device may have adjustable legs which allow the device to be elevated at various levels.

An advantage of the present foldable refrigerator is that the present refrigerator may have rounded interior edges which help in keeping the interior clean.

Still another advantage of the present foldable refrigerator is that the device may have an extendable handle and wheels for pulling or pushing the device in a similar manner as luggage.

And another advantage of the foldable refrigerator is that the device has a solid, sturdy protective exterior surface which protects the interior of the device and its contents while still being lightweight.

Still another advantage of the present foldable refrigerator is that the refrigerator may have a gyroscope which allows the compressor of the refrigerator to always remain upright.

And an advantage of the present foldable refrigerator is that the present refrigerator may have an interior LED light.

Yet another advantage of the foldable refrigerator is that the device may have a window on the door which allows a user to save energy by determining what the user wants from inside the refrigerator prior to opening the door.

In an embodiment, the foldable refrigerator may have a speaker unit to produce sound.

For a more complete understanding of the above listed features and advantages of the present foldable refrigerator, reference should be made to the following detailed description of the preferred embodiments. Further, additional features and advantages of the invention are described in, and will be apparent from, the detailed description of the preferred embodiments.

DETAILED DESCRIPTION OF THE PREFERRED EMBODIMENTS

A foldable refrigerator is provided. The foldable refrigerator moves from a functional First Position A to a collapsed Second Position B. The foldable refrigerator may be folded into the collapsed Second Position B for transportation and/or storage. The foldable refrigerator has a telescoping extendable handle and wheels which allow pulling or pushing the refrigerator in a manner similar to luggage. The refrigerator further has extendable and adjustable legs which allow the refrigerator to be raised or lowered to various heights. The refrigerator has a gyroscope which allows the compressor of the refrigerator to remain in an upright position.

Figure 1:
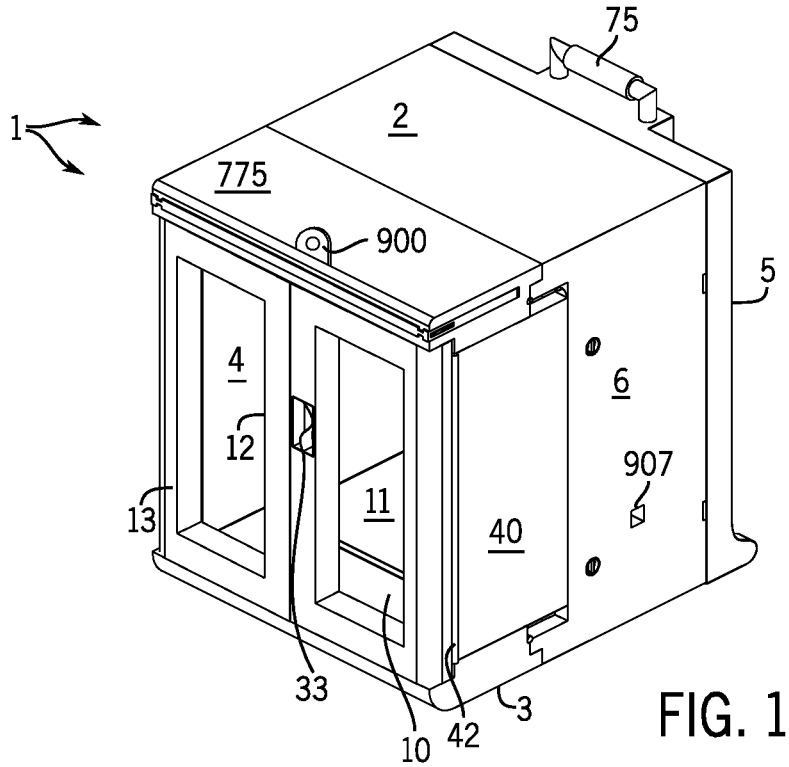
FIG. 1 illustrates a front perspective view of the First Embodiment of the foldable refrigerator in the functional First Position A.

Referring now to FIG. 1, a foldable refrigerator 1 is provided. The foldable refrigerator 1 may have a top 2, a bottom 3, a front 4, a back 5, a first side 6, a second side 7 (FIG. 3) and a generally hollow interior 8 for storing items such as food. The top 2, bottom 3, front 4, back 5, first side 6 and second side 7 of the device 1 may be constructed with insulated walls so as to reduce heat exchange between the outside of the refrigerator 1 and the interior 8 of the refrigerator 1. In an embodiment, the interior 8 may be approximately four cubic feet (although embodiments may vary dramatically).

The foldable refrigerator 1 may be largely made from an insulating material such as, for example, foam rubbers (polyurethanes), aerogels (silicon dioxides), neoprene or carbon black. The insulating material may be highly foldable so as to allow the foldable refrigerator 1 to move from a collapsed Second Position B (the stored position of FIGS. 2 and 11) to a functional First Position A (the usable position of FIG. 1). In the functional First Position A (FIG. 1) the foldable refrigerator 1 may be in a largely cubic configuration when compared to the collapsed Second Position B wherein the foldable refrigerator 1 is in flatter configuration. In the collapsed Second Position B, the refrigerator 1 occupies a smaller total volume than when the refrigerator 1 is in the unfolded First Position A.

Figure 5:
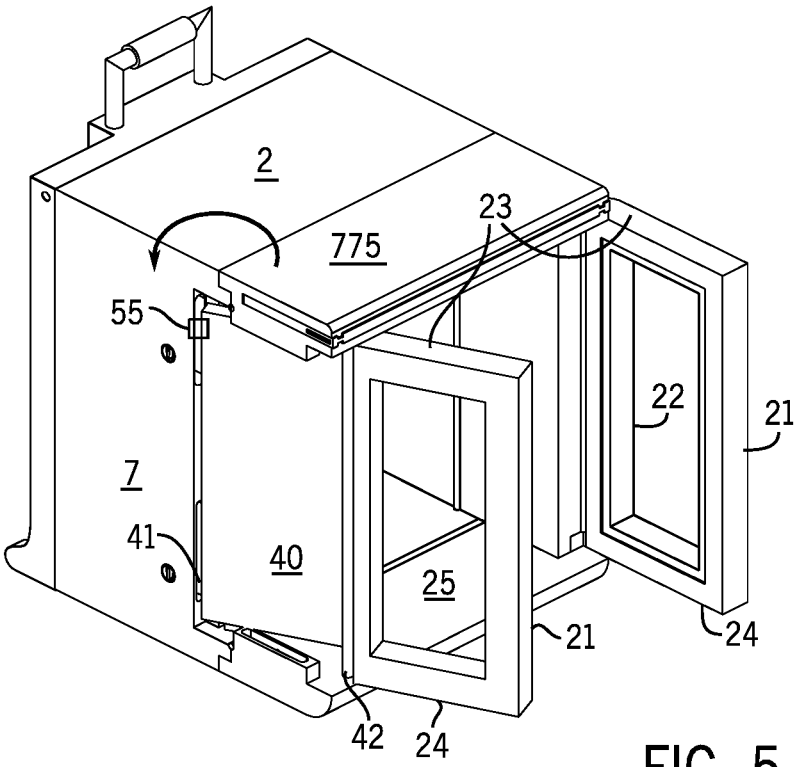
FIG. 5 illustrates a view of the foldable refrigerator wherein the doors are open and one of the side panels is rotated partially inward.

The front 4 of the foldable refrigerator 1 may have two doors 10. In an embodiment, each door 10 may have a large window 11 so as to allow a user to see inside the interior 8 of the refrigerator 1 without the need to open the door 10. The window 11 may have a first side 12, a second side 13 and a back (which faces the interior 8 of the refrigerator 1). As shown in FIG. 5, each of the doors 10 may have a first side 21, a second side 22, a top 23, a bottom 24 and a front 25 having the window 11. In an embodiment, the second side 22 of the door 10 may be permanently secured to a movable panel 40 of the side 6, 7 of the refrigerator 1. More specifically, the second side 22 of the door 10 may be connected to a movable panel 40 via a hinge 42 so that the doors 10 may be opened and closed while the movable panels 40 remain temporarily secured to the sides 6, 7 of the refrigerator 1.

Figure 6:
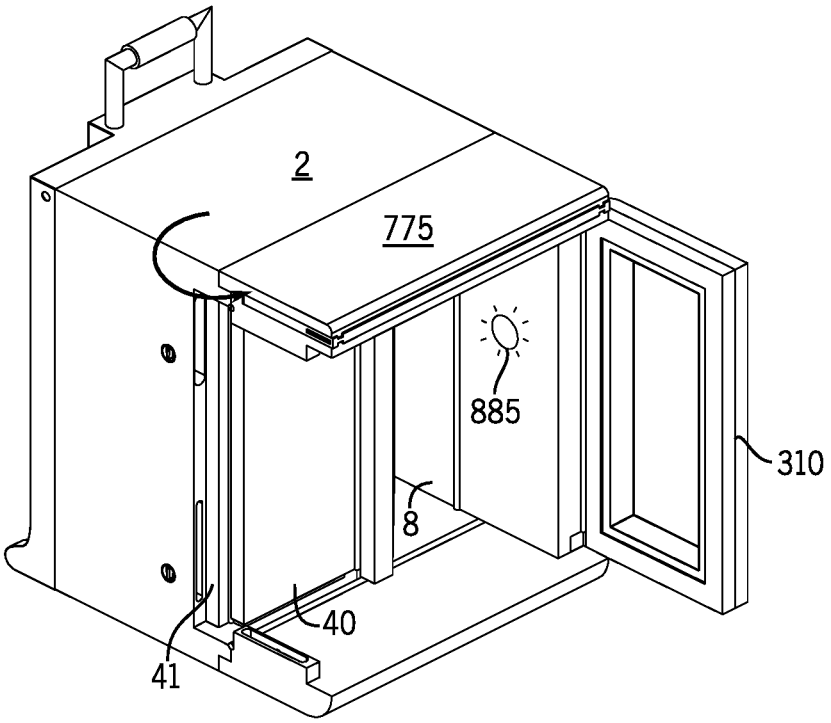
FIG. 6 illustrates a front perspective view of the foldable refrigerator wherein one of the doors and one side panel is rotated inward and the refrigerator is in the process of being folded.

The panels 40 of the side 6, 7 of the refrigerator 1 may be secured to the sides 6, 7 of the refrigerator 1 at a second hinge 41. The second hinge 41 may allow the panels 40 to move from a closed position (FIG. 1) to an open position (FIG. 6) or vice versa. In the open position of FIG. 6 the refrigerator 1 may be in the process of being folded (for storage) or unfolded (for use as a refrigerator).

As stated above, a first hinge 42 may be located between the movable panel 40 and the door 10 itself. The first hinge 42 may allow the door 10 to be opened or closed like a standard refrigerator door whereas the second hinge 41 may allow the movable panel 40 to rotate inward to collapse the refrigerator 1 for storage. In the usable orientation of FIG. 1, the first hinge 42 is operational whereas the second hinge 41 is locked into place so that the movable panel 40 does not move.

When the first hinge 42 is activated, the user can access the interior 8 of the refrigerator 1. A lock 33 on the door 10 may allow the first and second doors 10 to be locked together so that the doors 10 cannot be opened. A lock 55 (FIG. 5) on the second hinge 41 may prevent the second hinge 41 from being operational during use.

Figure 2:
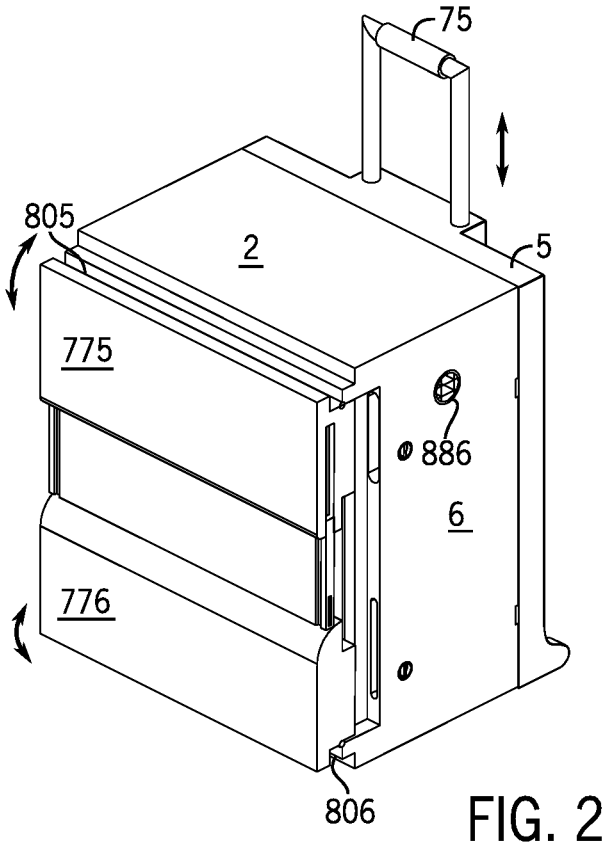
FIG. 2 illustrates a front perspective view of the foldable refrigerator wherein protective top and bottom panels are rotated over the side panels and the doors and wherein the handle is extended.

In an embodiment, the refrigerator 1 may also have a top movable panel 775 and a bottom movable panel 776. The top movable panel 775 may rotate from a horizontal position as shown in FIG. 1 to a folded (vertical) orientation as shown in FIG. 2. In the horizontal orientation, the top movable panel 775 is in the functional position perpendicular to the back 5 of the refrigerator 1 so that the refrigerator 1 may be used to store and cool items. In the folded orientation of FIG. 2, the top movable panel 775 is generally parallel to the back 5 of the refrigerator 1 and the refrigerator 1 is collapsed for storage. The bottom movable panel 776 operates and moves in a similar manner as the top movable panel 775. The top movable panel 775 may rotate at a hinge 805 and the bottom movable panel 776 may rotate at a hinge 806. The top movable panel 775 is secured to the top 2 of the refrigerator 1 and the bottom movable panel 776 is attached to the bottom 3 of the refrigerator 1.

In an embodiment, the top movable panel 775 and the bottom movable panel 776 cover, protect (including the windows which may be glass) and conceal the side movable panels 40 and the doors 10 when the top movable panel 775 is rotated downward and the bottom movable panel 776 is rotated upward (as shown in FIG. 2). As a result, when the top movable panel 775 and the bottom movable panel 776 are in the folded orientation, the refrigerator 1 occupies a smaller volume than when the top movable panel 775 and the bottom movable panel 776 are in their function orientation (as shown in FIG. 1). As a result, when the refrigerator 1 is in the folded orientation of FIG. 2 the total depth of the refrigerator is reduced. In particular, as shown in the comparisons between FIGS. 1 and 2, the total distance from the terminal front 4 of the refrigerator 1 to the terminal back 5 of the refrigerator 1 is reduced when the refrigerator 1 is in the collapsed/folded orientation of FIG. 2.

Figure 10:
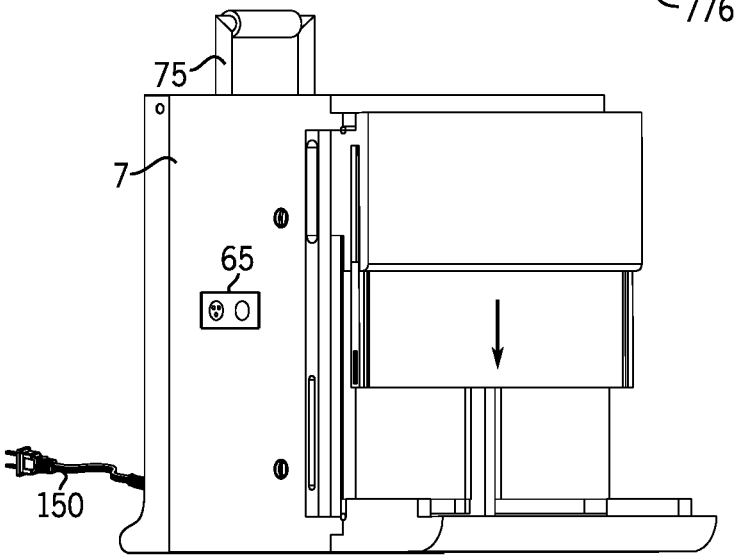
FIG. 10 illustrates the foldable refrigerator in the process of being folded.

To fold the refrigerator 1 into the collapsed orientation of FIG. 2, the side panels 40 and doors 10 are rotated inward first and then the top movable panel 775 and the bottom movable panels 776 are rotated inward so that the side movable panels 40 are concealed and protected by the top and bottom movable panels 775, 776. In an embodiment, the top movable panel 775 has a concealed protective interior layer (shown in FIG. 10 with a downward arrow on it). The concealed protective interior layer may slide downward (and out from the interior of the top panel 775) when the top movable panel 775 is rotated downward as shown in FIG. 10. The concealed protective interior layer may be partially covered by the bottom panel 776 when the bottom panel 776 is rotated upward. As a result, the concealed protective interior layer covers the gap between the top movable panel 775 and the bottom movable panel 776 when the refrigerator 1 is folded. As a result, dust or other objects cannot gain access to the interior of the refrigerator 1 in the folded orientation. Further, in an embodiment, the concealed protective interior layer is magnetic and is attracted to the bottom panel 776 so as to keep the bottom panel 776 and the top panel 7775 secured together when the refrigerator 1 is folded.

In an embodiment, the window portion 11 may be made or, for example, glass or plastic, and may cover a large percentage of the front 25 of the door 10 so as to maximize the viewing area for the user. Preferably, the window portion 11 is thick so as to reduce the chance of breakage and so as to increase the R-factor to reduce heat exchange with the outside; therein conserving energy.

Figure 4:
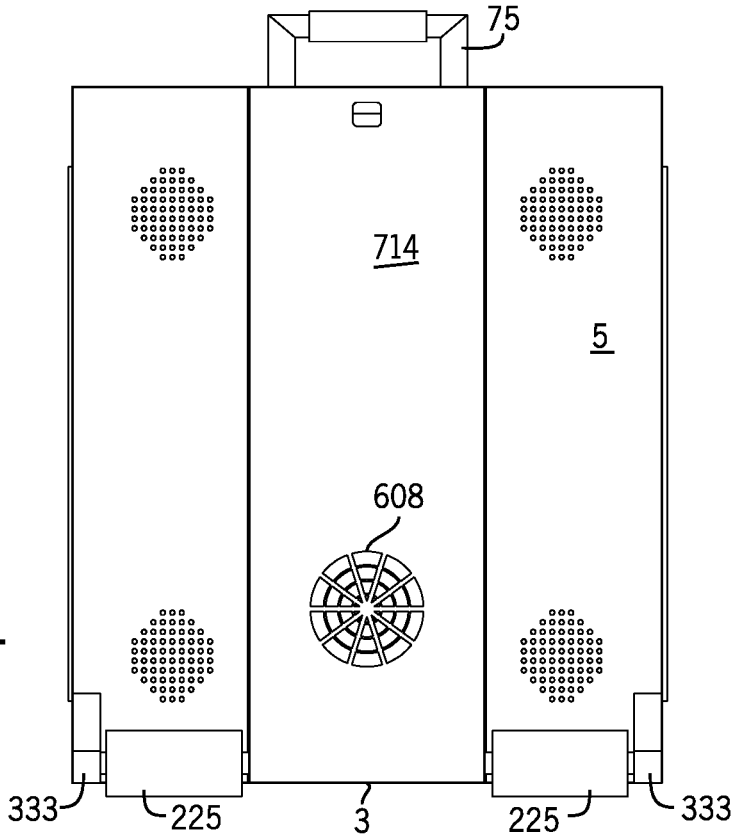
FIG. 4 illustrates a view of the back of the foldable refrigerator.

Referring now to FIG. 4, in an embodiment, the back 5 of the device 1 may have a wheel support assembly 333. The wheel support assembly 333 may be located at the bottom 3 of the device 1 and may allow wheels 225 of the refrigerator 1 to be securely attached to the device 1. In an embodiment, the wheel support assembly 333 may have a plurality of vertical groves which creates additional friction with the ground and allows the wheel support assembly 333 to act as a brake when a user is pulling the refrigerator 1 by a handle 75.

Figure 11:
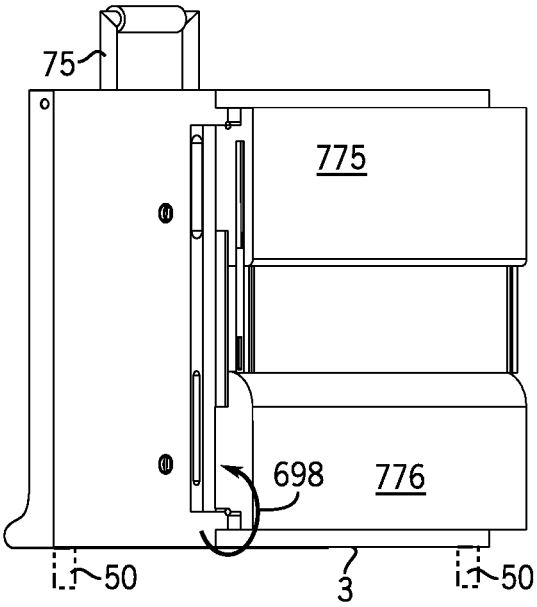
FIG. 11 illustrates the foldable refrigerator in the process of being folded.

Referring now to FIG. 11, located on the bottom 3 of the refrigerator 1 may be a plurality of telescoping extendable legs 50. Preferably, the refrigerator 1 has four telescoping extendable legs 50; however, the device 1 may have a greater or fewer number of telescoping extendable legs 50 so long as the device 1 remains stable when the legs 50 are extended and the refrigerator 1 is resting on the legs 50. The telescoping extendable legs 50 may move from a usable First Position A (FIG. 11) to a collapsed Second Position B (FIG. 10). In the collapsed Second Position B, the telescoping extendable legs 50 are substantially shortened and are located within a generally rectangular opening slot (not shown) located on the bottom 3 of the refrigerator 1.

In this collapsed Second Position B, in one embodiment, the extendable legs 50 are protected from damage which is more likely to occur when the extendable legs 50 are extended in the functional first Position A. In addition, in the collapsed Second Position B, the legs 50 are retracted and the device 1 is easier and more foldable to transport. In the collapsed Second Position B, the extendable legs 50 are generally in a flush orientation with the bottom 3 of the refrigerator 1 such that the refrigerator 1 may be placed on the ground and the extendable legs 50 will not contact the ground.

In the functional First Position A, the telescoping extendable legs 50 are extended away from the bottom 3 of the device 1. As a result, the bottom 3 of the refrigerator 1 may be elevated to allow for easier access for the user. In addition, when the telescoping extendable legs 50 are extended, a storage area is created under the bottom 3 of the refrigerator 1 for storing items. In an embodiment, the telescoping extendable legs 50 may have notches (not shown) which interact with grooves (not shown) located within the upper portion of the extendable legs 50. The notches of the extendable legs 50 may allow the extendable legs 50 to be raised or lowered to various heights.

Figure 9:
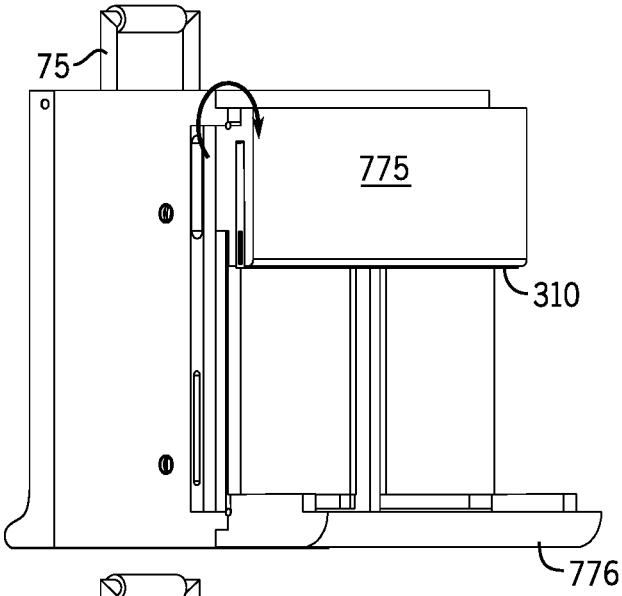
FIG. 9 illustrates the foldable refrigerator in the process of being folded.

The refrigerator 1 may further have an extendable handle 75 which move from a functional First Position A (FIG. 9) to a collapsed Second Position B (FIG. 1). In an embodiment, the extendable handle 75 may extend from within hollow tubes (not shown) located within an interior portion of the back 5 of the refrigerator 1. The extendable handle 75 may extend upward, away from the main body of the device 1 and may allow the device 1 to be easily carried or transported. The extendable handle 75 may operate and work similar to an extendable handle 75 often associated with luggage.

A power cord 150 (FIG. 10) may be attached to the foldable refrigerator 1. The power cord 150 may be attached to an electrical device (not shown) located within an inner wall of the device 1 which may power the device 1. Alternatively, or in addition to the electrical device, a battery (not shown) may be provided to power to refrigerator 1 giving the user the option of selecting alternating or direct current. In an embodiment, the battery may be a rechargeable battery. Further, the power cord 150 may be retractable and may be stored within an interior compartment opening when not in use. Preferably, the interior compartment opening is located on the back 5 of the device 1 and is deep enough so as to allow the power cord 150 to be stored in a flush manner with the back 5 of the device 1.

In an embodiment, the refrigerator 1 may have a battery management system (BMS) to provide protection and optimal use of both of the batteries and the refrigerator 1 itself. In an embodiment, the BMS may monitory a battery pack's individual cell level and may calculate the amount of current flow that can safely flow through the refrigerator 1.

Figure 3:
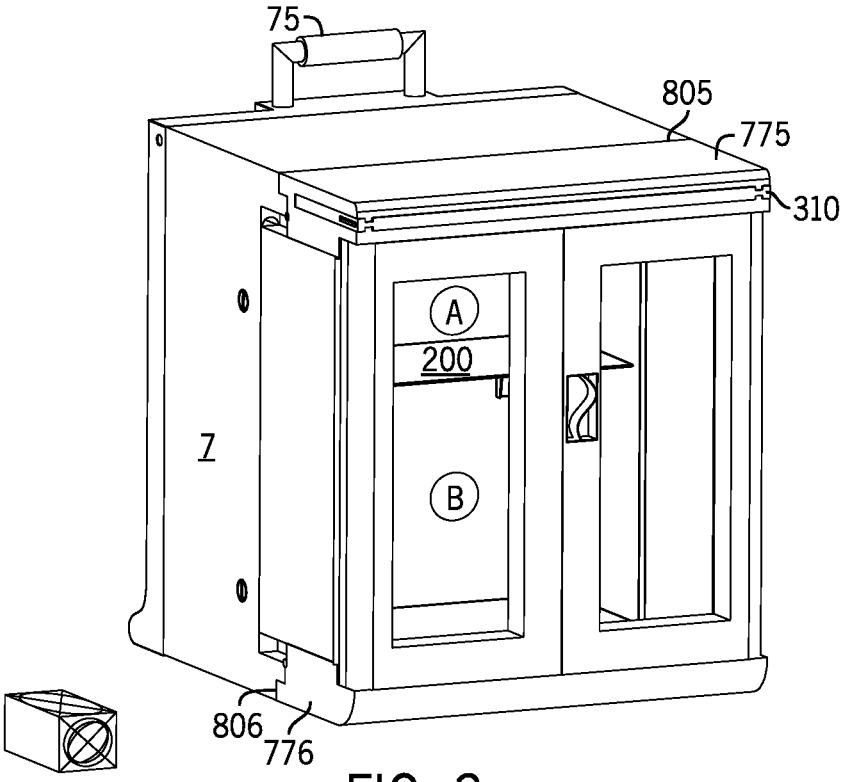
FIG. 3 illustrates a front perspective view of the foldable refrigerator in the usable orientation (functional First Position A).

As stated above, within the interior 8 of the device 1 (when the device 1 is in the functional First Position A) may be at least one of a plurality of adjustable shelves 200 (FIG. 3). The plurality of adjustable shelves 200 may divide the interior 8 of the device 1 into multiple compartments;

therein allowing the interior 8 of the device 1 to have at least two different temperature settings, if desired. For example, the interior 8 of the device 1 may have a first section (A) (FIG. 3) which may remain around forty degrees Fahrenheit for drinks and most other food items and a second section (B) which may remain below freezing to act as a freezer section to store, for example, ice cream. In an embodiment, the plurality of shelves 200 may be made of an insulating material such as a strong insulating glass. In an embodiment, the shelves 200 may be removed from the interior 8 of the device 1 so as to allow the entire interior 8 to remain a consistent temperature. In an embodiment, the plurality of adjustable shelves 200 (and interior walls themselves) may be rounded so as to help a user clean the interior of the refrigerator.

Figure 7:
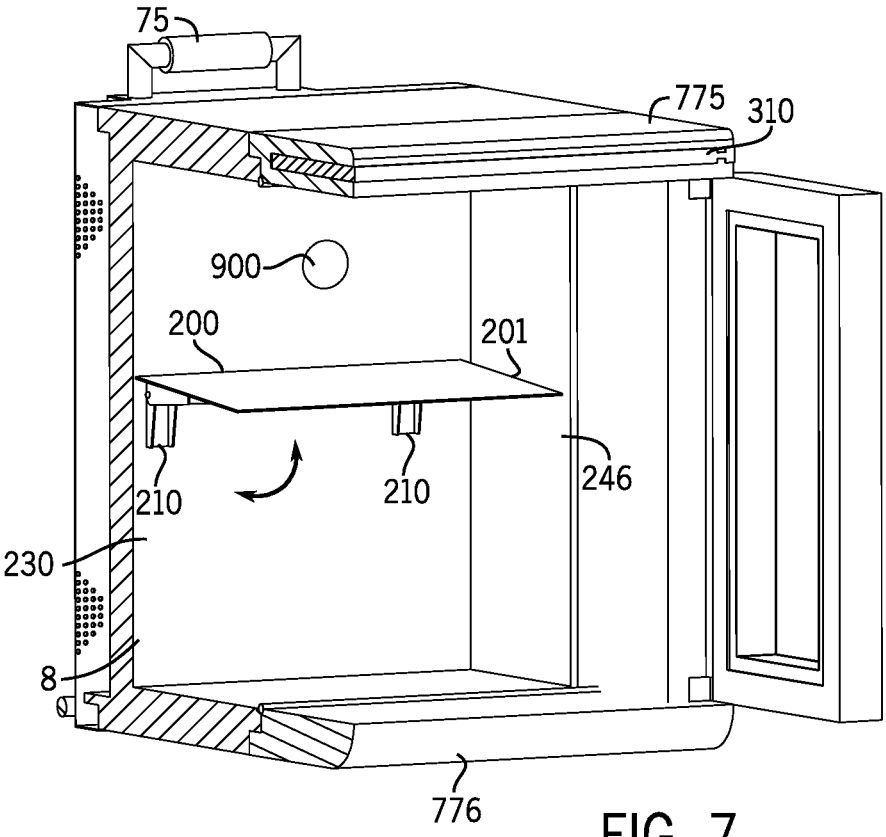
FIG. 7 illustrates a cross-sectional perspective view of the foldable refrigerator wherein one of the doors is open and wherein the shelf is in the horizontal orientation.
Figure 8:
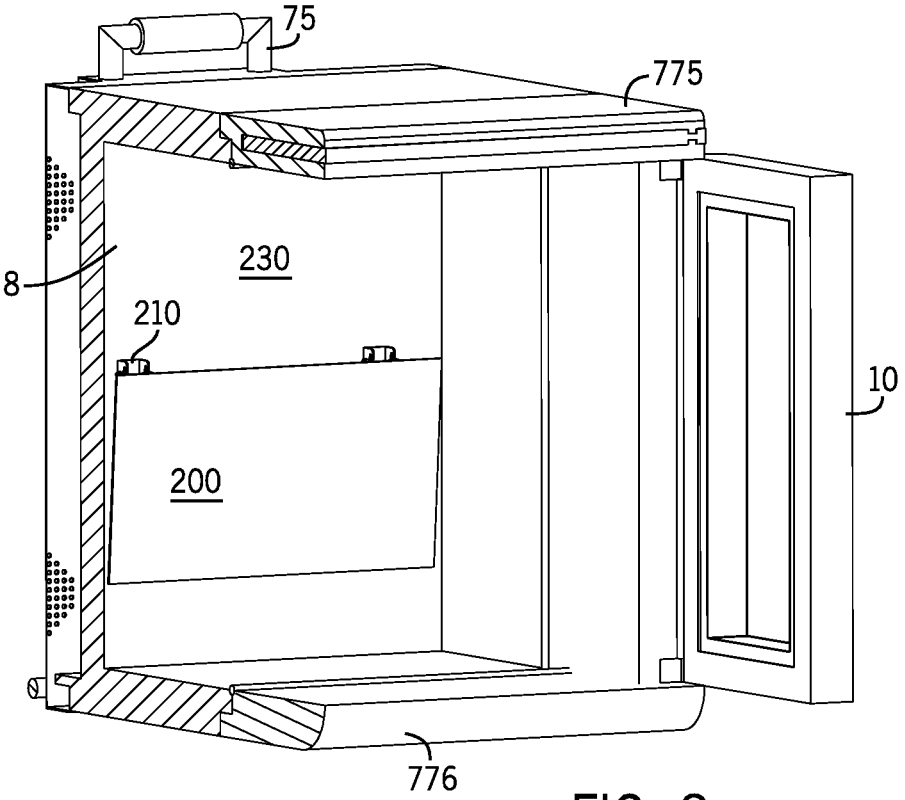
FIG. 8 illustrates the cross-sectional perspective view of the foldable refrigerator of FIG. 7 wherein the shelf is in the folded (or vertical) orientation.

Referring now to FIGS. 7 and 8, in an embodiment, the shelves 200 are secured to an inside back wall 230 of the refrigerator 1 via a locking hinge 210 which allows the shelve 200 to be in the functional horizontal position (FIG. 7) to hold items, to a folded vertical position of FIG. 8. In the folded orientation of FIG. 8, the shelves 200 may allow tall items to be stored within the interior 8 of the refrigerator 1. Further, in the folded orientation of FIG. 8, the shelves 200 are folded during the folding process for storage of the refrigerator 1.

In an embodiment, when the shelves 200 rotated into the upward useful position (FIG. 7), the sides 201 of the shelves 200 may contact the interior wall surfaces 246 (FIG. 7) of the sides 6, 7 of the refrigerator 1. More specifically, the length of the shelves 200 may be substantially similar to the distance between the interior wall of the first side 6 and the interior wall of the second side 7 of the refrigerator 1 when the refrigerator 1 is in the functional First Position A. As a result, the pressure from the sides 201 of the shelves 200 helps to keep the sides 6, 7 straight and locked into the functional First Position A orientation.

In an embodiment, the insulating material may be fire retardant. Further, the exterior of the device 1 is preferably light colored so as to reduce heat absorption. In an embodiment, a compressor 700 may be located on the exterior surface 8 of the device 1. The compressor 700 may be attached to the electrical device and may pull air into the device 1 wherein the air is cooled.

In an embodiment, the refrigerator 1 may have an interior light 885. Preferably, the interior light 885 is an LED light. The interior light 885 allows a user to view the interior contents more easily.

In an embodiment, the refrigerator 1 may have rotatable latches on one or both outer side of the solid body that will help in locking the folding part with solid body to prevent the mobility/motion of the walls during transportation.

Referring now to FIG. 10, in one alternative embodiment, the foldable refrigerator 1 may have an outlet 65 which may be used for, by way of example, a microwave, toaster oven or the like. The outlet 65 may be located on, for example, the side 7 of the refrigerator 1 and may allow the refrigerator 1 to be used as a secondary power receptacle, much like a standard electrical power strip. The outlet 65 would therefore allow the refrigerator 1 to be used in association with other small appliances or electrical devices by increasing the number of electrical devices that may be connected to a single electrical wall outlet.

In an embodiment, a gasket 310 may surround the perimeter of the doors 10 (as well as the movable panels 40 of the sides and top of the refrigerator 1). Preferably, the gasket 310 is made from rubber or silicon. The gasket 310 may create a liquid/air tight seal between the interior 8 of the refrigerator 1 and the outside. Further, the gasket 310 may prevent the loss of cool air from within the interior 8 of the refrigerator 1, therein saving energy.

Figure 12:
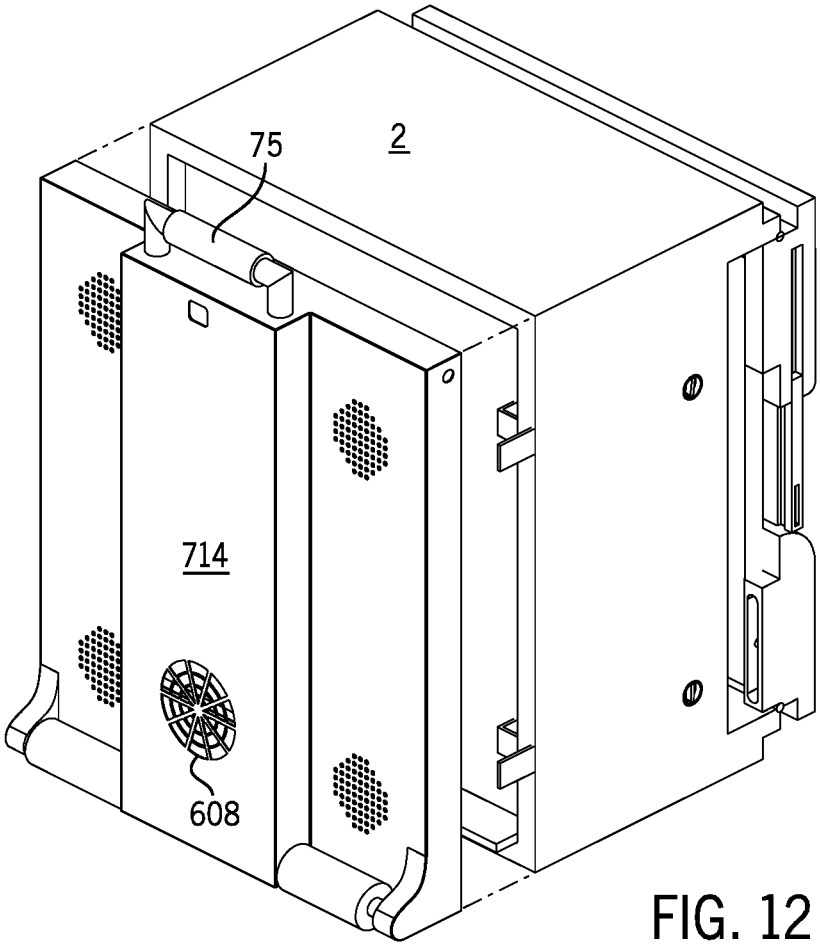
FIG. 12 illustrates a perspective view of the back of the foldable refrigerator.

Referring now to FIG. 12, in an embodiment, the refrigerator 1 may have a fan 608. The fan 608 may provide air flow to the interior of the device 1 so as to cool the motor (not shown). In an embodiment, the motor and electrical equipment is located within a back compartment 714 of the refrigerator 1.

Figure 13:
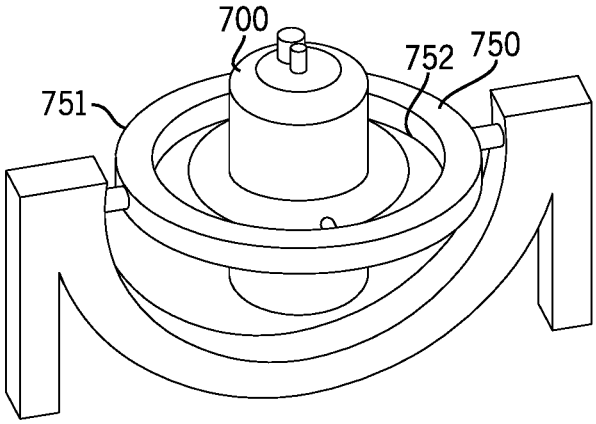
FIG. 13 a view of the gyroscope of the foldable refrigerator in one embodiment.

As with a standard refrigerator, the present refrigerator 1 may have a compressor 700 (FIG. 13). It should be understood that in an embodiment, the present refrigerator 1 may not use ammonia gas as a refrigerant and may instead use, for example, R134a.

In an embodiment, the compressor 700 of the present refrigerator 1 may be generally cylindrical in shape. The compressor 700 of the present refrigerator 1 may compress ammonia (or R134a) gas. The compressed ammonia (or R134a) gas may heat up as it is pressurized. Coils in the refrigerator 1 then let the hot ammonia (or R134a) gas dissipate its heat. The ammonia (or R134a) gas then condenses into ammonia (or R134a) liquid at a high pressure. The high-pressure ammonia (or R134a) liquid then flows through an expansion valve. On one side of the valve is a high-pressure ammonia (or R134a) liquid and on the other side of the valve is the low-pressure area. The liquid ammonia (or R134a) immediately boils and vaporizes, its temperature dropping to approximately −27 F therein making the refrigerator 1 cold. The ammonia (or R134a) gas is then sucked up by the compressor 700 and the process cycle repeats. In an embodiment, the coils are located within a gyroscope 750 (FIG. 13). In an embodiment, the compressor 700 may be electrically connected to a power source, such as a battery located within the compressor 700 or the compressor 700 may be connected to an AC power source.

As stated above, in an embodiment, the refrigerator 1 may have a gyroscope 750. The gyroscope 750 may have an exterior surface 751 and a generally hollow interior 752. Located within the interior 752 of the gyroscope 750 may be the compressor 700 of the refrigerator. The gyroscope 750 may allow the compressor 700 to remain in a generally upright orientation with respect to the ground. More specifically, the gyroscope 750 may allow the compression system 700 to function properly without, for example, the ammonia (or R134a) gas flowing improperly. Further, the gyroscope 750 may allow the compression system 700 to face any direction.

In one embodiment, the refrigerator 1 may have a camera 900. The camera 900 may be located at, for example, the top 2 of the refrigerator 1 as shown in FIG. 1 and/or within the interior 8 of the refrigerator 1 as shown in FIG. 7. The camera(s) may allow a user to remotely view the contents of the interior 8 of the refrigerator 1 through a computer app so that a user can see what he/she needs to purchase while actually being away from the refrigerator 1. For example, a user might be out running errands and may view the contents of the interior 8 of the refrigerator to see if he/she needs to purchase, for example, orange juice. A camera 900 located on top 2 of the refrigerator 1 may provide a security means for the user. A GPS tracker/locator 907 may allow a user to remotely determine the location of the refrigerator 1. In an embodiment, the GPS tracker 907 is concealed. In an embodiment, the security camera may provide a three-hundred-and-sixty-degree view of the surrounding area.

In an embodiment, the refrigerator 1 may have a speaker unit 886. The speaker unit 886 may allow a use to listed to music or other audio. The speaker unit 886 may be synced to anther device (such as a phone) by, for example, a wireless Bluetooth connection.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

The invention claimed is:

1. A foldable refrigerator comprising:

a housing having a top, a bottom, a front, a back, a first side, a second side and a generally hollow interior:

at least one door located on the front of the refrigerator wherein the door allows access to the interior of the refrigerator;

a camera located within the generally hollow interior of the refrigerator wherein the camera monitors contents of the generally hollow interior of the refrigerator;

wherein the first side of the refrigerator housing is divided into a first unit and a second unit;

wherein the first unit of the first side of the housing is connected to the back of the housing;

wherein the second unit of the first side of the housing is connected to the front of the housing;

wherein the first unit of the first side is connected to the second unit of the first side;

a hinge located between the first unit of the first side and the second unit of the first side and a hinge located between the second unit of the first side and the front of the refrigerator and wherein the hinge between the first unit and the second unit of the first side may be locked while the hinge between the second unit of the first side and the front of the refrigerator remains unlocked;

wherein the refrigerator folds from a first orientation to a second orientation wherein the first orientation the refrigerator occupies a greater volume than when the refrigerator is in the second orientation;

a first movable panel secured to the first side of the refrigerator wherein the first movable panel has a first side and a second side and wherein the first side of the first movable panel is secured to the first side of the refrigerator and wherein the second side of the first movable panel is secured to the door;

a top movable panel and a bottom movable panel wherein the top movable panel rotates from a first position to a second position and wherein the bottom movable panel rotates from a first position to a second position;

wherein the top movable panel has a first unit and a second unit and wherein a hinge is located between the first unit and the second unit of the top movable panel;

wherein the bottom panel has a first unit and a second unit and wherein a hinge is located between the first unit and the second unit of the bottom movable panel; and wherein the top movable panel and the bottom movable panel conceal the first movable panel when the first movable panel is rotated inward;

an interior layer located within the top movable panel wherein the interior layer slides partially outward from within an interior of the top movable panel when the top movable panel and the interior layer are rotated approximately ninety degrees to cover a portion of the front of the refrigerator and wherein the interior layer covers a gap located on the front of the refrigerator.

2. The foldable refrigerator of claim 1 further comprising:

a global positioning system tracker attached to the refrigerator.

3. The foldable refrigerator of claim 1 further comprising:

an audio speaker incorporated into the refrigerator.

4. The foldable refrigerator of claim 1 further comprising:

a camera located on an exterior surface of the refrigerator.

5. The foldable refrigerator of claim 1 wherein the door is partially transparent.

6. The foldable refrigerator of claim 1 further comprising:

a folding shelf located within the interior of the refrigerator wherein the folding shelf moves from a first position to a second position.

7. The foldable refrigerator of claim 1 further comprising:

a gasket on a perimeter of the door.

8. The foldable refrigerator of claim 1 further comprising:

a telescoping handle secured to the refrigerator.

9. The foldable refrigerator of claim 3 wherein the audio speaker is enabled with a Bluetooth wireless receiver.

10. The foldable refrigerator of claim 1 further comprising:

a folding shelf secured within the generally hollow interior of the refrigerator.

11. The foldable refrigerator of claim 1 further comprising:

at least one telescoping leg secured to the housing of the refrigerator.

12. The foldable refrigerator of claim 1 further comprising:

a fire-retardant material incorporated into the refrigerator.

13. The foldable refrigerator of claim 1 wherein the interior layer is magnetic.

* * * * *